United States Patent [19]

James

[11] Patent Number: 4,685,157

[45] Date of Patent: Aug. 11, 1987

[54] TOILET AID

[75] Inventor: David R. James, "Glenyard", England

[73] Assignee: James Industries Limited, Gloucester, England

[21] Appl. No.: 876,424

[22] Filed: Jun. 20, 1986

[30] Foreign Application Priority Data

Jul. 9, 1985 [GB] United Kingdom ..... 8517317

[51] Int. Cl.[4] ..... E03D 11/00

[52] U.S. Cl. ..... 4/254

[58] Field of Search ..... 4/254, 576, 560; 297/417, 116, 411, 412

[56] References Cited

U.S. PATENT DOCUMENTS

| | | | |
|---|---|---|---|
| 2,903,714 | 9/1959 | Grondona | 4/254 |
| 3,011,179 | 12/1961 | Hussey | 4/254 |
| 3,405,411 | 10/1968 | Brown | 4/254 |
| 3,474,471 | 10/1969 | Matibag | 4/254 |
| 4,144,597 | 3/1979 | Guenther et al. | 4/254 |

FOREIGN PATENT DOCUMENTS

| | | | |
|---|---|---|---|
| 1907229 | 9/1970 | Fed. Rep. of Germany | 4/576 |
| 2929239 | 2/1981 | Fed. Rep. of Germany | 4/254 |
| 1208432 | 9/1959 | France | 4/254 |
| 829836 | 3/1960 | United Kingdom | 4/576 |

*Primary Examiner*—Stephen Marcus
*Assistant Examiner*—Leo Peters
*Attorney, Agent, or Firm*—Collard, Roe & Galgano

[57] ABSTRACT

A toilet aid comprises a rear fixing bracket for mounting on a WC pan using the normal seat-attachment bolt holes of the latter. Two identical side support structures of inverted U-shape each provides a side user support arm, a front support leg and a rear support leg. The rear support legs extend through pivot bores in the bracket which provides lateral support for the legs with the side support structures independently pivotable about respective pivot axes.

7 Claims, 1 Drawing Figure

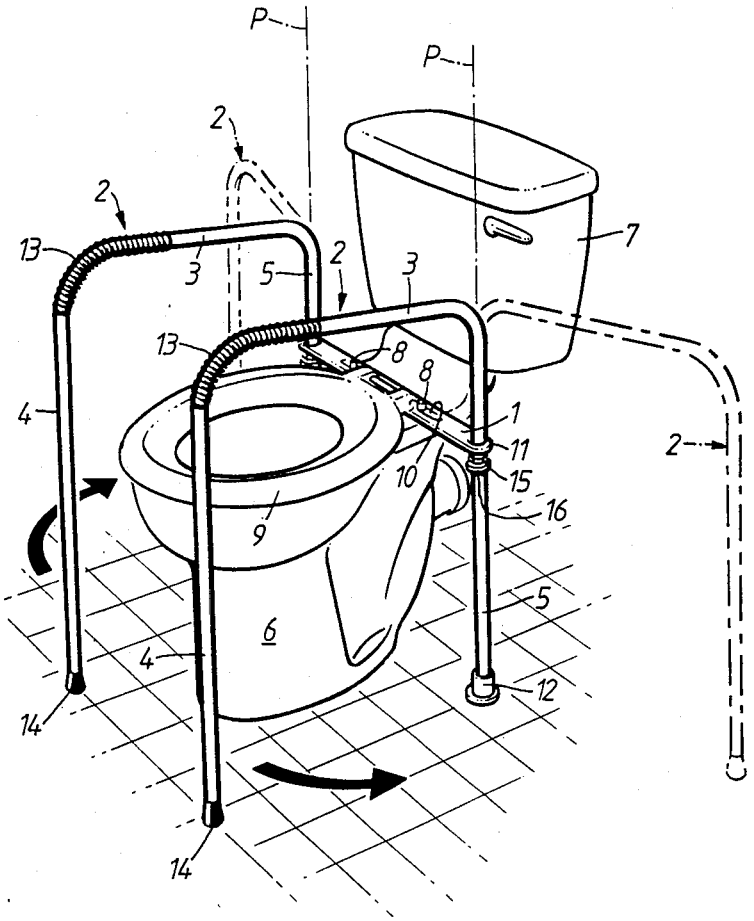
P
P
2
2
2
2
13
13
3
3
5
7
8
8
1
11
15
16
10
9
4
4
6
5
12
14
14

TOILET AID

BACKGROUND OF THE INVENTION

1. Field of the Invention

The invention relates to toilet aids designed to assist disabled, elderly and infirm patients to use a WC and of the type which is fixed relatively to the WC pan and provides side support arms for a user.

Such an aid helps a user to get on to and off the toilet seat, thereby in many cases enabling this to be done unaided, and provides side support for the user when seated.

2. Description of the Prior Art

Most toilet aids are rigidly fixed to the wall and/or floor in the region of the WC pan, and thus obstruct side access to the toilet seat. Toilet aids are known which are fixed to and supported by the WC pan itself, and in some cases these have side arms which can be moved out of the way to allow side access; however, the toilet pan has to withstand forces applied to the side arms which can be damagingly high, and the side arms cannot adopt an intermediate user support position.

SUMMARY OF THE INVENTION

The object of the invention is to provide a toilet aid which can be fitted in a very simple and easy manner and the construction of which facilitates side transfer of the user on to and off the toilet seat. A further object is to provide such a toilet aid with which damagingly high stresses cannot be applied to the WC pan in normal use, and wherein the side support arms can adopt intermediate support positions.

According to the invention a toilet aid comprises a rear fixing bracket for mounting on a WC pan using the normal seat-attachment bolt holes of the latter, side user support arms which are pivotally supported by the bracket for separate pivotal movement about respective vertical axes and front support legs which are continuous with the side arms and extend downwardly to contact the floor.

Although the side arms may be supported at the rear entirely by the fixing bracket it is preferred that the side arms should be continuous with rear support legs which are supported directly on the floor and which pass through the bracket so as to receive solely side support therefrom. The bottom ends of the rear support legs may be received in bearing cups fixed to the floor so as to provide lateral location for the bottom ends of the rear legs.

Each side arm and the corresponding front and rear support legs preferably comprises a single length of steel tubing bent to an inverted U-shape, providing at each side of the toilet pan a side arm structure of gate-like form which can be pivoted rearwardly and to the side, about the vertical axis defined by both the fixing bracket and the corresponding bearing cup, to allow toilet seat access from and to that side. Furthermore, such side arm structure is fully operative and can bear the weight of the user at any intermediate pivotal position.

Other features of the invention will be apparent from the following description, drawing and claims, the scope of the invention not being limited to the drawing itself as the drawing is only for the purpose of illustrating ways in which the principles of the invention can be applied. Other embodiments of the invention utilising the same or equivalent principles may be made as desired by those skilled in the art without departing from the present invention and the purview of the appended claims.

BRIEF DESCRIPTION OF THE DRAWING

The accompanying perspective drawing illustrates a toilet aid in accordance with the invention as fitted to a typical WC pan and used with a standard toilet seat.

DESCRIPTION OF THE PREFERRED EMBODIMENT

The toilet aid illustrated comprises a fixing bracket 1 and two identical side support structures 2 each of inverted U-shape providing a side user support arm 3, a vertical front support leg 4 and a rear vertical support leg 5 bent from a continuous length of steel tubing.

The bracket 1 is of simple form comprising a length of steel strip which extends laterally across the pan of a WC pedestal 6, the latter also supporting the usual low-level flush box 7. The bracket 1 is secured to the pedestal 6 by the seat-attachment bolts 8 which attach a standard toilet seat 9 to the pedestal 6 and utilise the normal seat-attachment bolt holes of the pan. To provide a universal fixing which accommodates the range of bolt spacings likely to be met in practice the bracket 1 has a long central bolt fixing slot 10.

Adjacent each end the bracket 1 has a bore 11 through which the corresponding rear support leg 5 extends, being closely received but able to turn freely therein. The bottom end of each leg 5 is received in a corresponding bearing cup 12 fixed to the floor, this cup being positioned directly below the corresponding bore 11 so as to define therewith a vertical pivot axis P. On a wooden floor the cups 12 can be secured by central fixing screws, whereas on a tiled or other solid floor they are preferably secured by adhesive means.

The junction between each side arm 3 and the corresponding front leg 4 is radiused off, as shown in the drawing, so as to provide a comfortable handgrip region over which it is sleeved by a length of corrugated plastics tubing 13. A plastics ferrule 14 pushed over the bottom end of each front support leg 4 is of a material which provides a satisfactory frictional grip with the floor when the corresponding side arm 3 is supporting any load, but which can otherwise slide reasonably freely along the floor to allow opening movement of the side arm structures 2 which each turns in the manner of a gate about the pivot axis P concerned. Any floor irregularity can easily be accommodated during such pivotal movement by flexing of the structure 2 and/or vertical movement of the corresponding rear leg 5 in the related bore 11 and cup 12, such vertical movement occurring against a light spring 15 which urges the leg 5 into the cup 12. The spring 15 is positioned between the bracket 1 and a collar 16 fixed on the leg 5, this collar limiting vertical upward movement to ensure that the leg 5 concerned cannot be lifted out of the corresponding cup 12.

What is claimed is:

1. A toilet aid comprising a rear fixing bracket, said bracket being adapted for mounting on a WC pan using the normal seat-attachment bolt holes of the latter, side user support arms pivotally supported by said bracket for separate pivotal movement about respective vertical axes, front support legs continuous with said side arms extending downwardly to contact the floor, rear support legs continuous with said side arms which in use are supported directly on the floor, said rear support legs passing through said bracket which provides solely side support for said rear support legs, and bearing cups fixable to the floor adapted to receive bottom ends of said rear support legs so to provide lateral location for the bottom ends of said rear support legs.

2. A toilet aid according to claim 1, wherein each of said bearing cups has a central screw-fixing hole and a generally flat bottom surface, whereby to allow alternative screw/adhesive fixing to the floor.

3. A toilet aid according to claim 1 wherein a junction between each of said side arms and the corresponding one of said front legs is rounded off to provide a comfortable handgrip region.

4. A toilet aid according to claim 3, wherein a handgrip sleeve is fitted over said handgrip region.

5. A toilet aid according to claim 1, wherein plastics ferrules are respectively fitted on the bottom ends of said front support legs and provide a frictional grip with the floor.

6. A toilet aid comprising a rear fixing bracket, said bracket being adapted for mounting on a WC pan using the normal seat-attachment bolt holes of the latter, side user support arms pivotally supported by said bracket for separate pivotal movement about respective vertical axes, and front support legs continuous with said side arms extending downwardly to contact the floor, rear support legs continuous with said side arms which in use are supported directly on the floor, said rear support legs passing through said bracket which provides solely side support for said rear support legs, each of said side arms and the corresponding front and rear suport legs being provided by a single length of steel tubing bent to an inverted U-shape so as to provide at each side o the toilet WC pan a side arm structure of gate-like form.

7. A toilet aid comprising a rear fixing bracket, said bracket being adapted for mounting on a WC using the normal seat-attachment bolt holes of the latter, side user support arms pivotally supported by said bracket for separate pivotal movement about respective vertical axes, front support legs continuous with said side arms extending downwardly to contact the floor, rear support legs continuous with said side arms which in use are supported directly on the floor, said rear support legs passing through said bracket which provides solely side support for said rear support legs, and spring which respectively surrounded said rear support legs below said bracket, said springs reacting with said bracket to urge said rear support legs towards the floor.

* * * * *